US006343557B1

(12) United States Patent
Rosvold

(10) Patent No.: US 6,343,557 B1
(45) Date of Patent: Feb. 5, 2002

(54) COMBUSTION FURNACE WITH GRATE AND ROD FEEDER

(76) Inventor: Helge Rosvold, Nordoskrentien 8, N-7032 Trondheim (NO)

( * ) Notice: Subject to any disclaimer, the term of this patent is extended or adjusted under 35 U.S.C. 154(b) by 0 days.

(21) Appl. No.: 09/555,100

(22) PCT Filed: Nov. 4, 1998

(86) PCT No.: PCT/NO98/00332

§ 371 Date: May 24, 2000

§ 102(e) Date: May 24, 2000

(87) PCT Pub. No.: WO99/30082

PCT Pub. Date: Jun. 17, 1999

(30) Foreign Application Priority Data

Nov. 25, 1997 (NO) ..... 19975397

(51) Int. Cl.[7] ..... F23K 3/18

(52) U.S. Cl. ..... 110/267; 110/101 R; 110/255; 110/258; 110/290; 110/111

(58) Field of Search ..... 110/101 R, 233, 110/245, 243, 244, 255, 256, 257, 258, 267, 268, 270, 290, 292, 298, 111, 114, 235, 165 R, 286, 287; 198/749, 736; 414/736, 198, 214

(56) References Cited

U.S. PATENT DOCUMENTS

| | | | | | |
|---|---|---|---|---|---|
| 551,342 | A | * | 12/1895 | Wentworth | 110/170 |
| 835,952 | A | * | 11/1906 | Jenkins et al. | 110/269 |
| 1,939,366 | A | * | 6/1933 | Preston | 110/269 |
| 1,965,317 | A | * | 7/1934 | Preston | 110/44 |
| 3,279,628 | A | * | 10/1966 | Brouwer et al. | 214/26 |
| 4,534,301 | A | * | 8/1985 | Sakash et al. | 110/255 |
| 4,796,544 | A | * | 1/1989 | Overgaard | 110/196 |
| 4,944,383 | A | * | 7/1990 | Petrachkoff | 198/468.6 |
| 5,103,744 | A | * | 4/1992 | Tunstromer | 110/233 |
| 5,265,543 | A | * | 11/1993 | Hamaker et al. | 110/269 |
| 5,323,717 | A | * | 6/1994 | Gaskin | 110/291 |
| 5,568,776 | A | * | 10/1996 | Suraniti et al. | 110/245 |
| 5,899,317 | A | * | 5/1999 | Chisaki | 198/550.1 |
| 5,992,334 | A | * | 11/1999 | Von Wedel | 110/300 |

FOREIGN PATENT DOCUMENTS

| | | | |
|---|---|---|---|
| EP | 0 060 236 | | 9/1982 |
| SE | 435317 B | | 9/1984 |
| SE | 8703508 A | * | 3/1988 |
| SE | 501226 C2 | | 12/1994 |

* cited by examiner

*Primary Examiner*—Denise L. Esquivel
*Assistant Examiner*—K. B. Rinehart
(74) *Attorney, Agent, or Firm*—Crompton, Seager & Tufte LLC

(57) ABSTRACT

A combustion furnace for solid fuel, including combustable fuel, wherein the furnace is arranged with a grate (11) with openings (12) which are situated for supply of air or another gas mixture for combustion. A first and second rod feeder (1, 2) is provided which includes parallel bars (3*a*, 3*b*; 4*a*, 4*b*) with intermediate carriers (5, 6). The rod feeders (1, 2) are arranged to be moved back and forth on the grate (11), independently of each other. The openings (12) are surrounded by spacers (13) carrying rails (14) in such a way that slots (15) are formed between the spacers (13) and the rails (14), so that the air has a direction out onto the grate (11) which is parallel with the rail (11).

5 Claims, 2 Drawing Sheets

COMBUSTION FURNACE WITH GRATE AND ROD FEEDER

Figure 1:
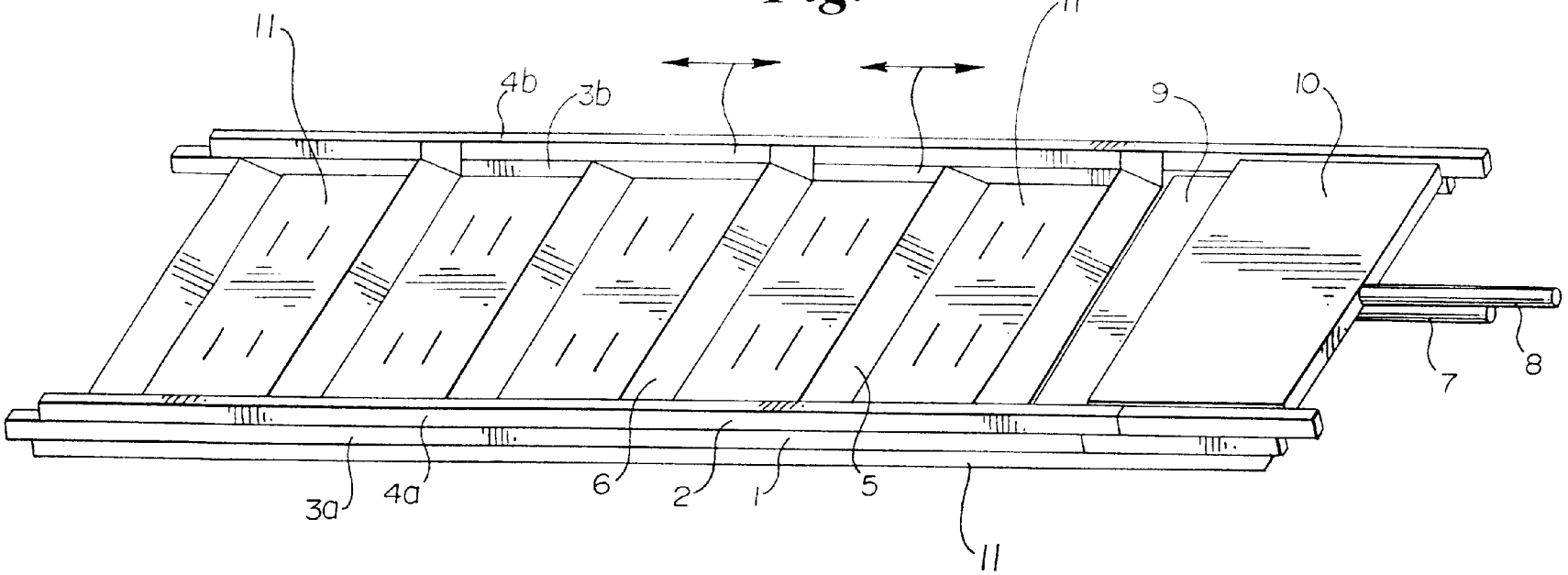

The present invention concerns a combustion furnace for solid fuel, including combustable fuel, as stated in the introductory part of claim 1.

So called "Refined Derived Fuel", RDF, is the result of sorting out non-combustible elements from household waste, etc. RDF can be mixed with cortex and wood chips in order to acheive a better calorific value. This fuel is burned in special furnaces to extract the optimum amount of energy while keeping pollution as low as possible. Such furnaces should also be able to process other solid materials, such as all kinds of biomass, mud, and certain types of hazardous waste.

In principle, a furnace for combustion of RDF operates in a manner where the fuel is supplied at a grate which is located over a primary air chamber, the chamber often being divided in sections. The combustion furnace is divided into a primary chamber and a secondary chamber, where the fuel is burned in two steps.

A disadvantages with known grate furnaces of this type is that it is difficult to acheive an optimum combustion, both for utilization of energy and reduction of pollution. This is substantially due to the furnaces not being flexible, and not including control options for adjustment of fuel of different consistency and content.

For a large part, this is solved through a furnace as described by NO-patent No. 176 455. Here the combustion chamber is separated into a primary and secondary combustion chamber, which is at least partly separated by a dividing plate. Furthermore, under the grate is situated an air supply divided into a certain number of zones which are individually controllable and have a supply of air and recirculated fume gas, preferably with a high temperature. However, it is still not possible to regulate the supply of fuel in a flexible way, for optimum utilazion of the furnace. In order to achieve an optimum combustion, it is also important that the supply of primary air to the grate is distributed as evenly as possible.

Combustion furnaces for waste, where the fuel is supplied to a grate situated above a primary air chamber are known for example from SE Patent Application No. 9301253-2 and SE Patent No. 501 226.

SE-9301253-2 discloses a simple rod feeder for transferring fuel to a primary air chamber. The disadvantage with such a rod feeder is that a risk exists that the fuel only will be lead back and forth in a kind of pendulum movement, giving an uneven distribution.

SE-501 226 also describes a simple rod feeder but has, in addition, counter scrapes which are fixed to the grate. This furnace achieves a transfer of the fuel which to a certain degree is more effective. However, it is difficult to achieve a totally even distribution of the fuel along the grate, as clusters of fuel will form in the vicinity of the stationary counter scrapes.

Furthermore, SE-501 226 discloses primary air supply from below through channels equipped with holes. However, this will cause the combustion to be uneven and most intensive in the area where the air goes into the grate.

It is thus an object with present invention to provide a device of the above mentioned kind where both the fuel and air for combustion are supplied and distributed evenly along the grate, for an optimum combustion.

The object of the invention is achieved with a combustion furnace having features as stated in the characterizing part of claim 1. Further features are apparent from the accompanying dependent claims.

Figure 2:
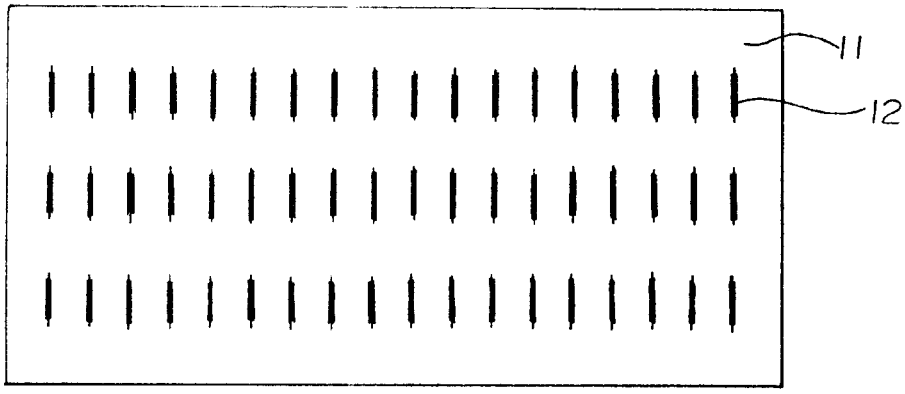
Figure 3:
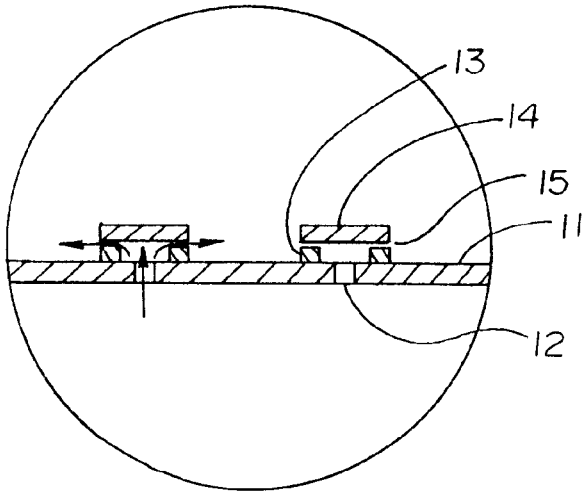

In the following detailed description of the invention reference will be made to a preferred embodiment, illustrated by the accompanying drawings, where FIG. 1 shows a view of a twin piston feeder and twin rod feeder according to present invention, FIG. 2 shows a grate according to the present invention, without rails mounted over the ventilation slots, and FIG. 3 shows a section of a detail of a grating, according to the present invention, with rails mounted.

In FIG. 1 is illustrates lower and upper rod feeders 1, 2, which are arranged for lying on a grate in a combustion furnace, for example as shown in NO-Patent No. 176 455. Each rod feeder 1, 2 is made up of two rectangular tubes 3*a*, 3*b*; 4*a*, 4*b*, which inbetween are equipped with a plurality of carriers 5 and 6, respectively. The carriers 5 are attached to the rectangular tubes 3*a*, 3*b*, and the carriers 6 are attached to the rectangular tubes 4*a*, 4*b*. The rod feeders 1, 2 can be moved independently of each other, back and forth on the grate. Preferably, the rectangular tubes 3*a*, 3*b* lie below tubes; 4*a*, 4*b* for each of the rod feeders 1, 2.

At the end of the rod feeders 1, 2 where fuel is supplied, two piston feeders 7, 8, are situated comprising two plates 9, 10, where one plate 10 is situated above the other plate 9. The piston feeders 7, 8 can be moved independently of each other and independently of the rectangular tubes 3*a*, 3*b*; 4*a*, 4*b*, back and forth, for providing fuel to the carriers 5, 6, and to a grate (not seen in FIG. 1). Fuel is supplied to the piston feeders 7, 8 from above in a per se known manner.

In the embodiment illustrated, the plates 9, 10 are situated at the same level as the carriers 5, 6. Depending upon the kind of fuel or other conditions, the plates 9, 10 can be situated at a higher level than the carriers 5, 6.

The carriers 5, 6 have a cross section that has a substantially closed V-shape, so that one of the legs of the V bears against the grate, and the tip of the V bears against the piston feeders 7, 8. The side of the carriers 5, 6 that are furthermost from the piston feeders 7, 8 include a plate part that is substantially 90° against the grate.

The carriers 5, 6 for each of the rod feeders 1, 2 lie at the same level, even though the rectangular tubes 3*a*, 3*b*; 4*a*, 4*b* lie opposite each other.

The combination of mutual independent piston feeders 7, 8 and rod feeders 1, 2 gives a system for transfer of fuel which is very flexible. Through utilization of the regulation option which lies in this system, the fuel quantity, distribution of fuel along the grate and thus full control of the fuel supply, make it possible to control the combustion process from the supply side, in such a way that optimum combustion is achieved. Simultaneously, the capacity of the combustion furnace can be regulated in a much better way than in known furnaces.

FIG. 2 shows a grate 11, seen from above, with openings 12 formed as slots for supply of air or another gas mixture to the combustion process. The slot-shaped openings 12 are arranged in rows on the grate 11. FIG. 2 shows two such rows.

FIG. 3 shows a cross section of a part of the grate 11. In both sides of each opening 12 is arranged a pair of spacers 13, on which are situated rails 14 in such a way that slots 15 are formed between the spacer 13 and the rails 14. The air is supplied from below grate 11 through the openings 12 and exits horizontally out through the slots 15. This construcion provides a better spread of air and together with the optimum distribution which is achieved by the double rod feeder 1, 2, will bring an even combustion in the furnace.

What is claimed is: claims:

1. Combustion furnace for solid fuel, including combustable fuel, said furnace comprising:

a grate with an opening that is situated for supply of air or another gas mixture for combustion;

a first rod feeder is arranged in order to transfer fuel out onto the grate, the rod feeder including parallel bars with intermediate carriers, the rod feeder being arranged to be moved back and forth on the grate;

wherein the openings are surrounded by spacers carrying rails in such a way that slots are formed between the spacers and the rails, so that air has a direction out onto the grate which is parallel with the rail; and a second rod feeder is arranged for transporting fuel out on the grate, the rod feeder including parallel bars with intermediate carriers, the rod feeder being arranged for movement back and forth on the grate, independently of the first rod feeder.

2. Furnace according to claim 1, characterized in that the openings are in the form of slots arranged in rows on the grate (11).

3. Furnace according to claim 1 or 2, characterized in that carriers (5, 6) on the first and second rod feeder (1, 2) lie on the same level on the grate (11).

4. Furnace according to claim 1 further comprising a double piston feeder disposed at one end of the rod feeders.

5. Furnace according to any of claims 1–4, characterized in that the double piston feeder (7, 8) comprises two mutually independently movable plates (9, 10).

* * * * *